US007360574B2

(12) United States Patent
Maumi et al.

(10) Patent No.: US 7,360,574 B2
(45) Date of Patent: Apr. 22, 2008

(54) DEVICE FOR CONTROLLING A VENETIAN BLIND

(75) Inventors: Pierre-Luc Maumi, Marseilles (FR); Laurent Passini, Auriol (FR); Dominique Quillot, Salon de Provence (FR)

(73) Assignee: Mariton S.A. (FR)

( * ) Notice: Subject to any disclaimer, the term of this patent is extended or adjusted under 35 U.S.C. 154(b) by 221 days.

(21) Appl. No.: 10/570,927

(22) PCT Filed: Aug. 6, 2004

(86) PCT No.: PCT/FR2004/002107

§ 371 (c)(1),
(2), (4) Date: Mar. 3, 2006

(87) PCT Pub. No.: WO2005/028802

PCT Pub. Date: Mar. 31, 2005

(65) Prior Publication Data

US 2006/0283561 A1 Dec. 21, 2006

(30) Foreign Application Priority Data

Sep. 5, 2003 (FR) ..... 03 10570

(51) Int. Cl.
*E06B 9/30* (2006.01)

(52) U.S. Cl. ..... 160/170; 160/173 R

(58) Field of Classification Search ..... 160/166.1, 160/168.1 P, 168.1 R, 168.1 V, 170, 171, 160/173 R, 176.1 P, 321, 84.02; 242/390.8, 242/390.9, 394, 394.1; 475/331; 254/297
See application file for complete search history.

(56) References Cited

U.S. PATENT DOCUMENTS

| | | | | |
|---|---|---|---|---|
| 4,513,805 | A * | 4/1985 | Mase | 160/299 |
| 6,076,587 | A * | 6/2000 | Pastor | 160/115 |
| 6,123,140 | A * | 9/2000 | Bergamaschi | 160/316 |
| 6,752,194 | B1 * | 6/2004 | Huang | 160/168.1 R |
| 2003/0221799 | A1 * | 12/2003 | Cross et al. | 160/168.1 P |
| 2005/0056383 | A1 * | 3/2005 | Huang | 160/170 |

FOREIGN PATENT DOCUMENTS

| | | |
|---|---|---|
| FR | 1 583 460 A | 10/1969 |
| WO | WO 01/27431 A1 | 4/2001 |

* cited by examiner

*Primary Examiner*—Brian E. Glessner
*Assistant Examiner*—Jeremy C Ramsey
(74) *Attorney, Agent, or Firm*—Lucas & Mercanti, LLP

(57) ABSTRACT

The invention relates to a device for controlling a venetian blind, the device comprising a top module for transforming rotary movement of a horizontal drive roller into rotary movements in a determined direction a horizontal driven roller. According to the invention, the top module contains first and second epicyclic gear trains connected in series, each gear train presenting a set of parallel-shafted planet gears meshing in a respective ring and containing a rotary planet carrier, the direction of rotation of the planet gears of one of the trains being reversed relative to that of the planet gears of the other one of the trains by mutual meshing, the planet gears of the second rotary planet carrier being rotated by the horizontal drive roller, while the second rotary planet carrier is constrained to rotate with the horizontal driven roller.

10 Claims, 3 Drawing Sheets

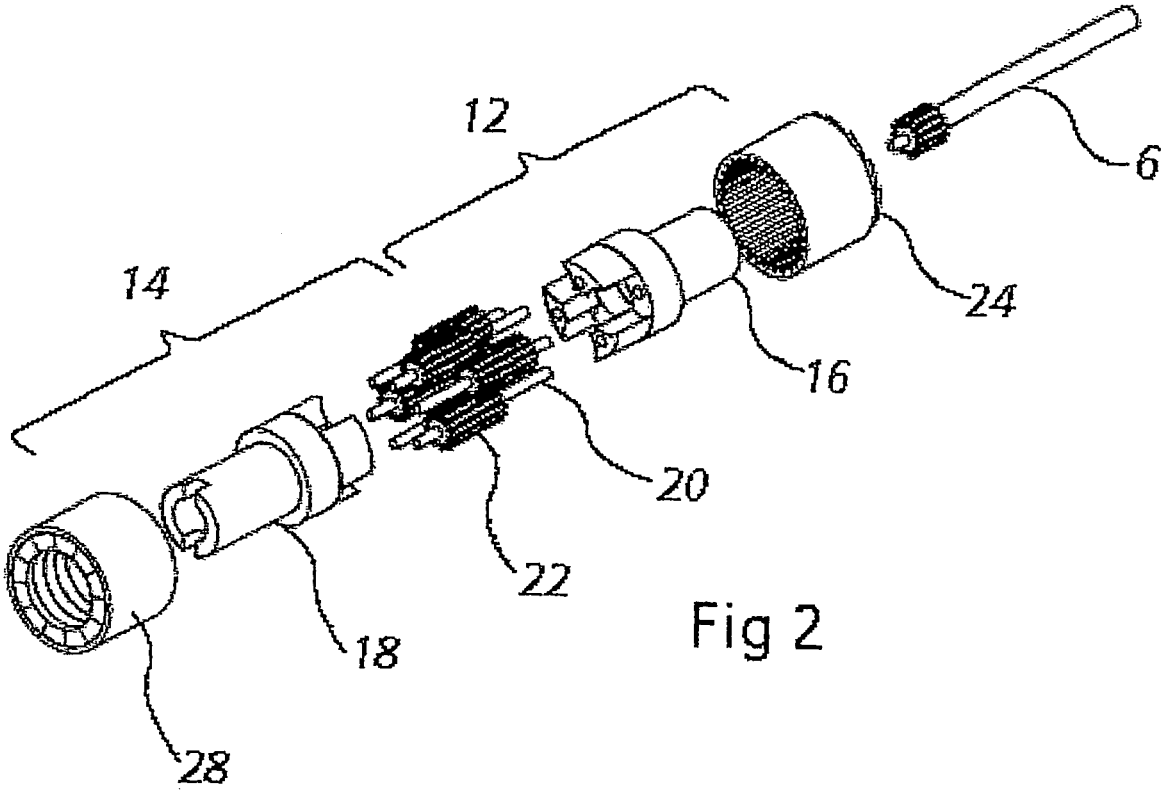
Fig 2
Fig 3A
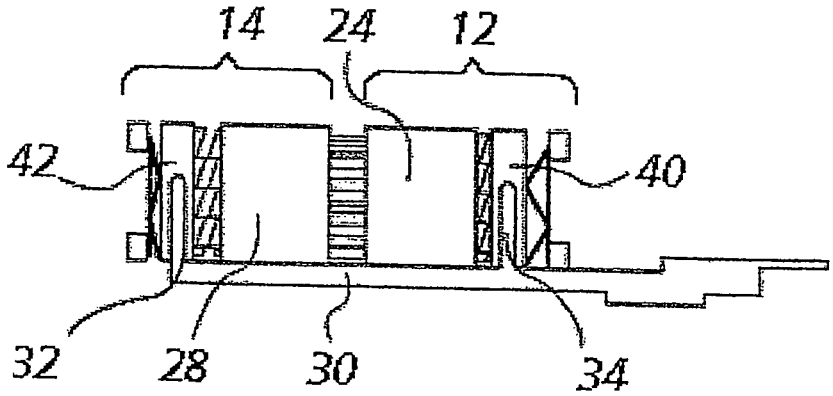
Fig 3B
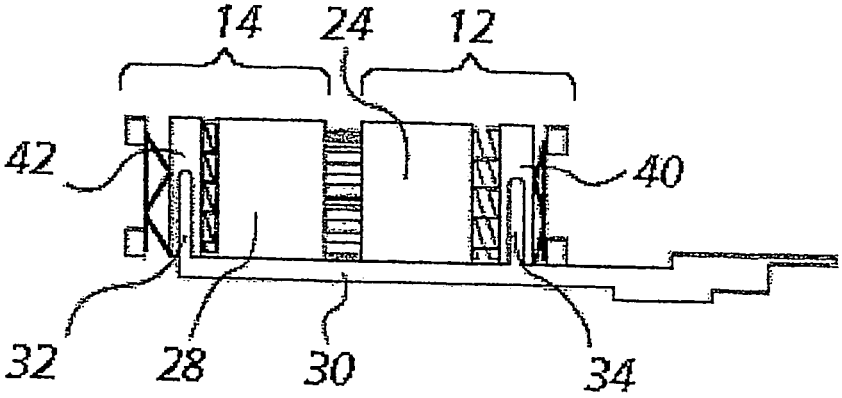

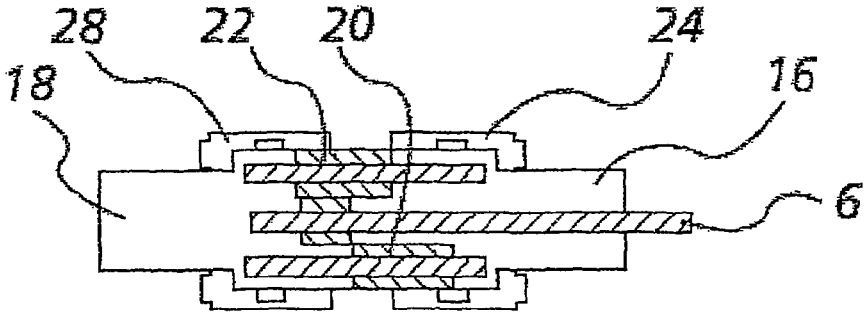
Fig 4
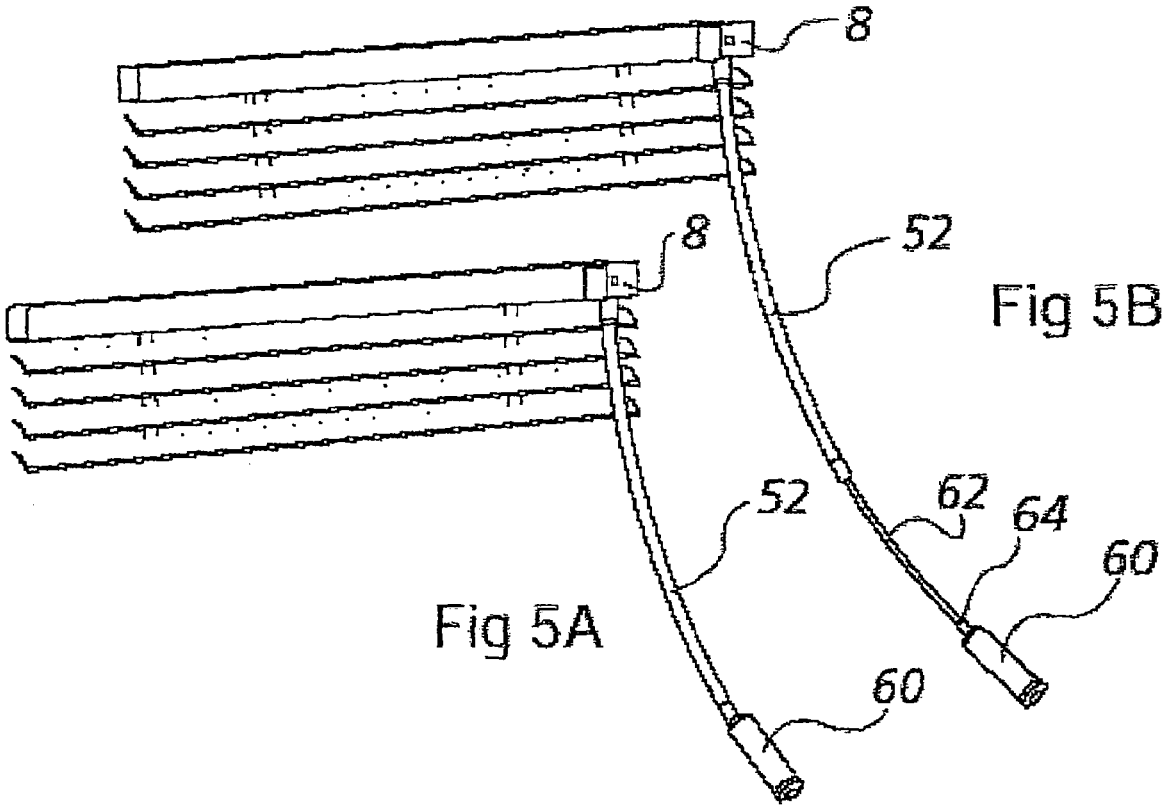
Fig 5B
Fig 5A

DEVICE FOR CONTROLLING A VENETIAN BLIND

The invention relates to controlling blinds of the venetian blind type having horizontal slats.

BACKGROUND OF THE INVENTION

In general, such a blind comprises a vertically-deployable panel made up of horizontal slats supported by ribbon ladders and terminated by a horizontal bottom end bar of position that is determined by means of at least two cords suitable for being wound on a horizontal driven roller of a top module that transforms rotary movement of a horizontal drive roller into rotary movement in a determined direction of said horizontal driven roller, as is well known in the art.

In general, each rung of the ribbon ladder carries a substantially horizontal blade that is tiltable about this relative horizontal direction in order to adjust its angle and obstruct the access of light to a greater or lesser extent.

Blinds of this type thus require a plurality of separate controls, in particular for raising or lowering the horizontal bottom bar and for tilting the blades. In conventional manner, these controls are separated in such a manner that one line serves to raise or lower the horizontal bottom bar, and another line serves to adjust the tilt of the blades.

That type of control using lines generally presents the drawback in that the lines easily become tangled together or twisted about each other.

Numerous attempts have been made to reduce this number of controls into a single control that is more practical for the user, and above all that can be operated remotely using simple electrical means. Examples can be found, amongst others, from the following documents: EP-A-1 213 438, EP-A-1 156 182, WO-A-01/27431, or U.S. Pat. No. 5,850, 863.

Other types of such blinds are also described in the following documents: EP-A-1 072 753, EP-A-1 063 386, WO-A-02/95177, EP-A-1 170 458, and WO-A-02/57586.

None of the above-specified devices enables such a blind to be lowered or raised by the user performing the same simple action.

OBJECT AND SUMMARY OF THE INVENTION

The invention lies in this context, and seeks to simplify the control of such a blind very considerably, in particular such a blind that is of the horizontal venetian type. Nevertheless, it finds applications for other types of blind.

According to the invention, the top module comprises first and second epicyclic gear trains disposed in series, each gear train presenting a set of parallel-shafted planet gears meshing with a respective ring disposed around a rotary planet carrier. The planet carrier of one of the gear trains receives one of the ends of the shafts, while the planet carrier of the other one of the gear trains receives the other ends of the shafts. The direction of rotation of the planet gears of one of the gear trains is reversed relative to that of the planet gears of the other one of the gear trains by mutual meshing, the planet gears of the second rotary planet carrier being rotated by the horizontal drive roller, while the second rotary planet carrier is constrained to rotate with the horizontal driven roller.

Preventing one of the rings from turning thus determines the direction in which the horizontal driven roller rotates.

According to the invention, one of the rings is prevented from rotating by means of a carriage provided with two pairs of teeth and movable horizontally in translation in such a manner as to prevent one only of the rings from rotating, while leaving the other one free to rotate.

For this purpose, and advantageously, the carriage is secured to a pair of claw clutches capable of preventing the rings from moving in rotation in such a manner that only one of the rings is prevented from moving in rotation while the other one remains free to rotate.

To simplify control, the horizontal drive roller is caused to rotate by pulling a drive cable having one end wound at rest on a resiliently-biased drive reel that is free to rotate in a determined direction.

Preferably, the drive cable passes inside a hollow shaft carrying an eccentric cam at its top end and having its opposite end suitable, at rest, for engaging in a shape provided on a control handle for the drive cable.

BRIEF DESCRIPTION OF THE DRAWINGS

The invention can be better understood and other objects, advantages, and characteristics thereof appear more clearly on reading the following description of a preferred embodiment given in non-limiting manner and with reference to the three accompanying sheets of drawings, in which:

FIG. 2 is a perspective and exploded view showing the two epicyclic gear trains placed in series in the top module of FIG. 1;

FIGS. 3A and 3B are diagrams showing the means for changing direction of rotation of the horizontal driven roller of the FIG. 1 top module;

FIG. 4 is a diagrammatic longitudinal section view showing the two epicyclic gear trains of the top module when assembled together; and FIGS. 5A and 5B are fragmentary diagrams of a blind in accordance with the invention respectively in its rest position and in its pulled position.

MORE DETAILED DESCRIPTION

Figure 1:
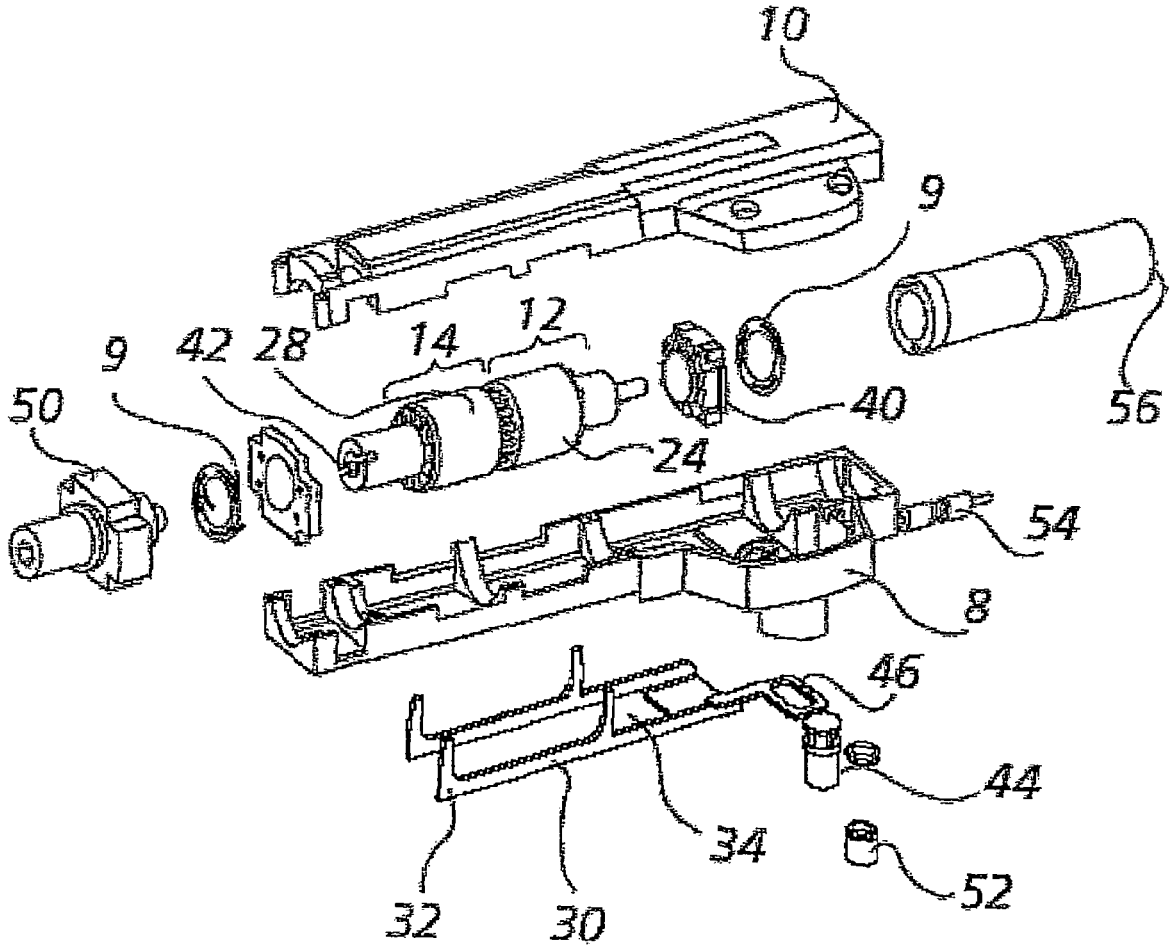
FIG. 1 is a perspective and exploded view of a top module of the device in accordance for controlling a blind.

Reference is now made to the figures briefly summarized above. The blind itself is not shown as such in the figures, since it is well known to the person skilled in the art. Nevertheless, FIGS. 5A and 5B show the blind in part in association with the device for controlling the blind.

In general, a blind comprises a vertically deployable panel made up of horizontal slats supported by ribbon ladders and terminated by a bottom end horizontal bar whose position is determined by means of at least two cords or tapes suitable for being wound on a horizontal driven roller (not shown in the figures).

A top module, as shown in FIG. 1, comprises a device that transforms rotary movement of a horizontal drive roller 6 into rotary movement of another roller, a horizontal driven roller which is rotated in a determined direction.

The top module is constituted by a casing made up of a bottom 8 and a cover 10 enclosing the mechanism for transforming the rotary movement.

The mechanism essentially comprises a first epicyclic gear train 12 in series with a second epicyclic gear train 14.

Each of the epicyclic gear trains 12 and 14 comprises a planet carrier 16, 18, a set of planet gears 20, 22, and a ring 24, 28. In the example shown, each set of planet gears 20, 22 comprises three gears.

The planet carrier of one of the trains receives one of the ends of the shafts of the planet gears, while the planet carrier of the other one of the trains receives the other ends of said shafts. The planet gears in each of the sets presents zones of mutual meshing, and outside said zones, a zone of teeth that naturally mesh with teeth provided on the inside face of the corresponding ring 24, 28.

Clearly the shafts of the planet gears 20, 22 are parallel to one another and constrained to rotate together.

The drive roller 6 always rotates in the same direction and meshes with the set of centripetal planet gears 22 of the second epicyclic train 14.

The second planet carrier 18 drives the driven roller about which the above-mentioned cords or tapes of the blind are wound. The second planet carrier 18 can turn in either direction, as explained below.

It will be understood that the planet gears of one set drive the planet gears of the other set in opposite directions of rotation.

As mentioned above, the horizontal drive roller 6 presents a determined constant direction of rotation, whereas the driven roller must be capable of rotating in one direction or in the opposite direction in order either to lower or to raise the panel of the blind. For this purpose, one of the rings 24, 28 must be prevented from rotating.

The direction of rotation of the driven roller is thus selected by selecting which ring is prevented from rotating.

If the ring 28 is prevented from rotating, then the ring 24 is free to rotate and both planet carriers 16 and 18 rotate together in the same direction as the drive roller 6. Conversely, if the ring 28 is free to rotate while the ring 24 is prevented from rotating, then both planet carriers 16, 18 rotate in the opposite direction of rotation to the drive roller 6.

Either one of the rings is prevented from rotation by means of a carriage 30 provided with two pairs of teeth 32, 34 disposed in such a manner as to engage only one of the rings 24, 28, leaving the other one free. The carriage 30 is movable in translation so as to select which ring is to be prevented from rotating.

Each pair of teeth 32, 34 of the carriage 30 is, in practice, part of a claw clutch 40, 42 suitable for holding stationary either the ring 24 or the ring 28, and in such a manner that only one of the rings is held stationary while the other one is left free. To this end, the clutches 40, 42 and the rings 24, 28 present corresponding facing radial toothed walls. Auxiliary spring means 9 act axially on the clutches serving to synchronize the facing teeth radial walls between a clutch and the corresponding ring.

The carriage 30 is moved in translation by an eccentric cam 44 co-operating with an opening 46 provided in the carriage 30.

An irreversible wheel means 50, e.g. making use of a spring, balls, or slugs, is placed at the outlet of the mechanism to prevent the panel of the blind dropping between two movements.

The panel of the blind is caused to move by means of a hollow shaft 52 carrying the eccentric cam 44 penetrating into the opening 46 of the moving carriage 30. Turning the shaft 52 through one-fourth of a turn or through half a turn thus causes the carriage 30 to move, and consequently changes which one of the rings is prevented from moving, and thus changes the direction of rotation of the horizontal driven roller. This thus provides control means determining whether the panel of the blind is raised or lowered.

In addition, a cable 62 (FIG. 5B) secured to a handle 60 passes along the inside of the hollow shaft 52 in order to serve as control means for the user. The top end of the cable, guided by a pulley 54 mounted to rotate freely about a horizontal axis is connected to a drive reel 56 which transforms the traction force exerted on the cable 62 by a user into rotary movement of the horizontal drive roller 6 via a freewheel (not shown in the figures). Spring means enable the drive reel 56 to be returned to its angular rest position.

When the user does not exert any traction on the cable 62, the handle 60 under return force from the drive pulley 56 comes into abutment against the hollow shaft 52 and engages in a shape 64 provided on the handle 60 so that in this position the handle 60 and the hollow shaft 52 are constrained to turn together.

In an embodiment, the length of the end of the cable that can be wound on the pulley is about 80 centimeters (cm).

Thus, when the user has decided that the panel of the blind should move up or down, then merely by turning the shaft 52 by means of the handle 60 held in the hand, the user need do no more than apply one or more successive pulls on the cable 62 that passes along the shaft 52. After each pull, the cable 62 is automatically returned by the resiliently-biased drive reel 56.

Such a linear pull has the effect of turning the drive reel 56 which transmits its rotary movement to the epicyclic gear trains 12 and 14 which then transmit rotary movement in one direction or the other to the driven roller.

The person skilled in the art will understand that this provides a control device for a blind of the "single-control" type that is very simple to use, inexpensive to make, and above all very compact, being compatible for use with a conventional blind top unit made of sheet metal, e.g. having a section of 25 millimeters (mm) by 25 mm.

The originality of this mechanism lies essentially in enabling the user to keep hold of the pull member, regardless of whether the blind is to be raised or lowered, so all of the control actions can be performed using one hand only. Changing from deploying the panel of the blind to retracting it is thus achieved merely by turning the drive handle.

In one example, and given constraints on space, the horizontal drive and driven rollers were provided with gearwheels having 12 teeth, both sets of three planet gears 20 and 22 each had 12 teeth, and the rings 24, 28 each had 36 teeth. With such an identical configuration for both epicyclic gear trains 12, 14, two different stepdown ratios are obtained: a ratio of ¼ for retracting the panel and a ratio of ½ for deploying the panel.

Thus, the user need not work so hard when retracting the blind, and benefits from deployment which is faster, being assisted by gravity.

Although the presently preferred embodiment of the present invention is described and shown above, it is clear that the person skilled in the art could apply various changes and modifications thereto without going beyond the ambit of the present invention as defined below.

What is claimed is:

1. A device for controlling a blind comprising a vertically-deployable panel made up of horizontal slats supported by ribbon ladders and terminated by a horizontal bottom end bar of position that is determined by means of at least two cords suitable for being wound on a horizontal driven roller of a top module that transforms rotary movement of a horizontal drive roller into rotary movement in a determined direction of said horizontal driven roller, wherein said top module comprises first and second epicyclic gear trains disposed in series, each gear train presenting a set of parallel-shafted planet gears meshing with a respective ring disposed around a rotary planet carrier, the planet carrier of one of said gear trains receiving one of the ends of said shafts, while the planet carrier of the other one of said gear trains receives the other ends of said shafts, the direction of rotation of the planet gears of one of said gear trains being reversed relative to that of the planet gears of the other one of said gear trains by mutual meshing, the planet gears of the second rotary planet carrier being rotated by the horizontal drive roller, while the second rotary planet carrier is constrained to rotate with the horizontal driven roller.

2. A blind-control device according to claim 1, wherein one of said rings is prevented from moving in rotation, thereby determining the direction of rotation of said horizontal driven roller.

3. A blind-control device according to claim 2, wherein one of said rings is prevented from rotating by means of a carriage provided with two pairs of teeth and movable horizontally in translation in such a manner as to prevent one only of said rings from rotating, while leaving the other one free to rotate.

4. A blind-control device according to claim 3, wherein said carriage is secured to a pair of claw clutches capable of preventing said rings from moving in rotation in such a manner that only one of said rings is prevented from moving in rotation while the other one remains free to rotate.

5. A blind-control device according to claim 4, wherein the clutches and the rings present corresponding facing toothed radial walls.

6. A blind-control device according to claim 3, wherein said carriage is caused to move horizontally under the control of an eccentric cam.

7. A blind-control device according to claim 1, wherein said horizontal drive roller is caused to rotate by pulling a drive cable having one end wound at rest on a resiliently-biased drive reel that is free to rotate in a determined direction.

8. A blind-control device according to claim 6, wherein said horizontal drive roller is caused to rotate by pulling a drive cable having one end wound at rest on a resiliently-biased drive reel that is free to rotate in a determined direction, and wherein said drive cable passes inside a hollow shaft carrying said eccentric cam at its top end and having its opposite end suitable, at rest, for engaging in a shape provided on a control handle for said cable.

9. A blind-control device according to claim 1, wherein the horizontal driven roller is connected to an irreversible wheel providing means for preventing the blind from dropping.

10. A blind-control device according to claim 1, wherein said two epicyclic gear trains connected in series present different reduction ratios on deploying and on retracting said panel.

* * * * *